US005509610A

United States Patent [19]

Gibbons et al.

[11] Patent Number: 5,509,610

[45] Date of Patent: Apr. 23, 1996

[54] CENTRIFUGAL CHOPPING AND GRINDING APPARATUS

[75] Inventors: Edgar G. Gibbons, Cincinnati, Ohio; Ronald E. Gibbons, Crestview Hills, Ky.; Jimmie A. Henke, Aurora, Ind.

[73] Assignee: Gibbco, Inc., Cincinnati, Ohio

[21] Appl. No.: 187,219

[22] Filed: Jan. 27, 1994

[51] Int. Cl.[6] ..... B02C 7/06; B02C 7/12; B02C 7/14

[52] U.S. Cl. ..... 241/37; 241/261.3; 241/298

[58] Field of Search ..... 241/261.2, 261.3, 241/298, DIG. 31, 37

[56] References Cited

U.S. PATENT DOCUMENTS

| | | | |
|---|---|---|---|
| Re. 30,011 | 5/1979 | Seifert | 241/46.06 |
| 2,064,666 | 12/1936 | Krushel . | |
| 2,101,442 | 12/1937 | Martinez . | |
| 3,545,513 | 12/1970 | Palyi et al. | 241/298 X |
| 3,568,940 | 3/1971 | Merges | 241/47 |
| 3,799,456 | 3/1974 | Jewell et al. | 241/37 |
| 3,827,644 | 8/1974 | Johansson | 241/259.3 |
| 3,942,730 | 3/1976 | Coucher | 241/248 |
| 4,023,737 | 5/1977 | Leider et al. | 241/261.3 |
| 4,039,152 | 8/1977 | Peterson | 241/245 |
| 4,039,153 | 8/1977 | Hoffman | 241/248 |
| 4,060,206 | 11/1977 | Granzow | 241/259.1 |
| 4,081,146 | 3/1978 | Yagi | 241/152 A |
| 4,082,233 | 4/1978 | Reinhall | 241/244 |
| 4,129,263 | 12/1978 | Sjöbom | 241/248 |
| 4,201,349 | 5/1980 | Walsh | 241/247 |
| 4,253,613 | 3/1981 | Reinhall | 241/16 |
| 4,269,365 | 5/1981 | Berggren | 241/261.2 |
| 4,454,991 | 6/1984 | Brenholdt | 241/30 |
| 4,684,070 | 8/1987 | Dicky | 241/79.3 |
| 4,684,071 | 8/1987 | Dicky | 241/80 |
| 4,927,088 | 5/1990 | Brewer | 241/223 |
| 5,195,684 | 3/1993 | Radzins | 241/57 |

*Primary Examiner*—John Husar
*Attorney, Agent, or Firm*—Wood, Herron & Evans

[57] ABSTRACT

An apparatus convertible between chopping or shredding operations and grinding operations. The centrifugal grinder or chopper includes two opposed plates with at least one plate rotating with respect to the other. A plurality of shearing plates are rigidly but removably secured to one mounting plate while a plurality of grinding segments or chopping and shredding knives are rigidly but removably secured to the other mounting plate. Each shearing plate includes a curved rib extending outwardly toward the other mounting plate. When one of the mounting plates is rotated with respect to the other, material is forced centrifugally outward into spaces or grinding chamber segments and chopped or ground before passing out of the spaces or grinding chamber segments and into an outlet. An automatic gap adjustment mechanism is further disclosed for setting the desired gap between the ribs of the shearing plates and the grinding segments or chopping and shredding knives. A rotating material distributing plate is further disclosed and is axially adjustable, for example, to accommodate wear of the grinding segments.

45 Claims, 7 Drawing Sheets

CENTRIFUGAL CHOPPING AND GRINDING APPARATUS

BACKGROUND OF THE INVENTION

The present invention generally relates to apparatus for size reduction of material pieces and, more specifically, to an apparatus convertible between chopping or shredding operations and grinding operations for first reducing material, such as waste automobile tires, into shredded form and then reducing the shredded material to powdered form.

Many types of chopping, shredding and grinding apparatus are known in the prior art for reducing particulate material into material composed of even smaller particulates. Particulate size reduction operations are generally performed in stages with each stage involving the use of a different cutting or grinding apparatus adapted to reduce the size of the particulates comprising the material from a specific larger size range to a specific smaller size range. Thus, several machines and operations are necessary in order to reduce large objects such as waste automotive tires into a useful, recyclable powdered form.

Two examples of apparatus for shredding waste automotive tires are disclosed in U.S. Pat. Nos. 4,684,071 and 4,927,088 issued respectively to Dicky and Brewer. Each of the devices disclosed in these patents utilizes rotating shafts which carry blade members for shredding whole, waste tires. Although these machines, as well as other similar machines, adequately reduce the tires into small pieces which reduce the space taken up in landfills, they are unable, or at least very inefficient at reducing the tires into the fine, powdered form necessary for recycling or other constructive uses of the rubber material. Finely powdered rubber may be added to asphalt for paving roads and highways or may be recycled and formed into various rubber products. Thus, efficient further reduction of waste automobile tires would potentially take these waste tires completely out of landfills and recommit their materials of construction to many useful purposes.

Various grinding apparatus are known which employ two grinding discs or plates having adjacent, opposed grinding faces. At least one of the plates rotates at high speed with respect to the other plate and particulate material is fed centrally into a grinding chamber or space defined between the two disks and is ground or reduced into particulate material as the material is centrifugally forced in a radial outward direction within the grinding space. Several examples of such machinery are found in the following U.S. Patents:

| U.S. Pat. No. | INVENTOR | ISSUE DATE |
|---|---|---|
| 4,039,153 | Hoffman | August 2, 1977 |
| 4,081,146 | Yagi | March 28, 1978 |
| 4,082,233 | Reinhall | April 4, 1978 |
| 4,129,263 | Sjöbom | December 12, 1978 |
| 4,201,349 | Walsh | May 6, 1980 |
| 4,253,613 | Reinhall | March 3, 1981 |

Each of the centrifugal grinders presented in the past have disadvantages and are unsuitable in many applications, especially with regard to the specific application of grinding waste automobile tires into a fine, powdered form. To applicant's knowledge, no centrifugal grinder of the past has been capable of grinding waste automobile tires into a finely powdered form. Moreover, the costs associated with the manufacture, operation and maintenance of past grinding machines capable of particle reduction to, for example, 20–100 mesh is very high. For example, the costs associated with manufacturing minute openings in the screens used in typical hammer mills and granulators are high especially when considering that the screens must be constantly replaced.

Other problems with past methods used to produce very minute particle sizes concern the undesirably long milling times which are necessary to produce a useful output batch of ground, powdered material. This inefficiency also adds to the overall costs associated with the grinding operation and, in turn, the cost of the output product.

Accordingly, there is a need in the art for apparatus and methods for grinding material, especially waste automobile tires, from the larger pieces easily produced by past apparatus down to sizes as low as 20–100 mesh in a fast and efficient manner by producing continuous high throughput volumes of such ground material. There is also a need for one apparatus which may be easily converted from a chopping or shredding apparatus able to produce pieces in approximately a ½"–1" size range to a grinding apparatus able to further reduce these pieces to particles sized at approximately 20–100 mesh. The need for multiple pieces of machinery for reducing material from the former size range to the latter size range would thus be eliminated.

SUMMARY OF THE INVENTION

It has therefore been one objective of the invention to efficiently grind large throughput volumes of material, especially waste automobile tires, down to sizes most useful for recycling purposes.

It has been a further objective of this invention to provide apparatus which is quickly and easily converted from a chopping or shredding machine to a grinding machine thereby eliminating the need for multiple pieces of machinery for reducing shredded material down to a powdered form which is most useful for recycling purposes.

It is still a further objective of this invention to provide a grinding machine which is easily adjustable to produce material pieces or particles of various sizes.

It is still a further objective of this invention to provide a grinding machine which includes an adjustable material distributing plate easily adjustable to accommodate the wear and/or different axial positions of grinding components in the machine.

It has been still another objective of this invention to provide a housing which is easily accessible by the user for inspection, maintenance, adjustment and changeover or conversion purposes.

To these ends, the present invention comprises apparatus for particulate size reduction including a housing having a material inlet and a material outlet. A first mounting plate is secured within the housing and includes a cutting surface comprised of a plurality of generally radially extending ribs protruding from one face thereof. Each of these ribs acts as a cutting or shearing member. The ribs include outer edges each having an outer surface wherein each of the outer surfaces of the ribs lie in a common plane. Each of the ribs are also preferably an integral part of a separate shearing plate removably affixed to the first mounting plate. The housing further contains a second mounting plate preferably mounted for rotation therein and including a cutting surface comprising a flat, but roughened or coarse annular grinding surface on one face thereof. Preferably, the grinding surface is formed as the aggregate of a plurality of flat, but roughened or coarse grinding surfaces of a respective plurality of cutting members or, more specifically, grinding segments removably affixed to the second mounting plate. The grinding surface is directly opposed and parallel to the outer edge surfaces of the ribs of the first mounting plate to define a series of grinding chamber segments between the first and second mounting plates and between the ribs extending from the first mounting plate. The product inlet and outlet of the housing communicate with the grinding chamber segments and function to respectively allow material to be fed into the grinding chamber and directed out of the grinding chamber and out of the housing when grinding is complete.

The first mounting plate having the individual shearing plates mounted thereto is preferably mounted within the housing in a nonrotating manner. A motor is operatively coupled to the second, rotatable mounting plate for rotating it with respect to the first, nonrotating mounting plate while product is ground within the grinding chamber segments and centrifugally forced radially outwardly into the product outlet.

In a chopping and shredding alternative construction of the invention, the roughened or coarse grinding surface of the second mounting plate is replaced by using a cutting surface defined by plurality of cutting members which more specifically comprise radially extending knives used during a chopping and shredding operation. The outer edges of the chopping and shredding knives lie in a common plane which is parallel to and directly adjacent the plane defined by the outer edge surfaces of the ribs on the shearing plates. The removability and replaceability of chopping or shredding knives and the grinding segments, allows the apparatus to easily be changed over or converted from a chopping and shredding machine to a grinding machine. The chopping and shredding embodiment produces pieces of shredded automobile tires, for example, of about ½" to 1" in size while the grinding embodiment can reduce these pieces to an average size of about 20 mesh or lower.

The preferred embodiment of the present invention further includes a material distributing plate rotatably mounted within the housing and disposed at a radial position between the grinding chamber segments and the material inlet. More particularly, the material distributing plate is mounted centrally of the annular grinding surface of the second plate. The material distributing plate includes a plurality of fins which direct the product from the material inlet into the grinding chamber where it is ground or chopped as dictated by whether grinding segments or chopping and shredding knives are attached to the rotatable mounting plate. The material distributing plate is axially adjustable or, in other words, fixable at various points along the axis of rotation thereof and with respect to the rotatable mounting plate in order to accommodate wear of the grinding segments or, if necessary, the axial position of the chopping and shredding knives. Preferably, the material distributing plate is rigidly affixed to the rotatable mounting plate and rotates about an axis coincident with the axis of rotation of the rotatable mounting plate.

In a further aspect of the invention, the nonrotating mounting plate is axially adjustable with respect to the rotating mounting plate. This axial adjustment allows the size of the gap between the ribs on the individual shearing plates and the grinding segments or the chopping knives to be adjusted to thereby adjust the output particle or piece size. Preferably, a gear motor is used to move the first, nonrotating mounting plate axially toward and away from the second, rotatable mounting plate. During the adjustment process, with both mounting plates in a nonrotating state, a control mechanism moves the first, nonrotatable mounting plate toward the second, rotatable plate until opposed surfaces of the outer edge surfaces of the ribs on the first mounting plate abut or contact the roughened or coarse grinding surface of the grinding segments or the outer edge surfaces of the chopping and shredding knives. When contact is made, a sensor detects a rise in current load on the gear motor and sends a signal to a control to stop the gear motor. At this point, the gear motor is reversed for a period of time corresponding to a predetermined or preselected gap between the ribs and the grinding segments or knives. The gap corresponds to the desired output particle or piece size.

In another aspect of the invention, the housing includes a door hingedly secured thereto which allows the grinding chamber to be easily accessed for inspection or maintenance purposes and, in addition, allows the grinding segments to easily be replaced with the chopping and shredding knives and vice versa. Further, the door allows the adjustable material distributing plate to be accessed and easily adjusted to the correct axial position as necessitated by the wear of the grinding segments and/or the axial position of the knives, as necessary. Also, as the ribs are preferably formed as part of individual shearing plates which are removably affixed to the first, nonrotating mounting plate, the hinged door further provides access for removing and replacing the shearing plates, as necessary.

Accordingly, the present invention provides chopping and grinding apparatus which is versatile enough to reduce large pieces of material down to powdered form in a multistage process. Further, apparatus constructed according to the present invention efficiently reduces waste automobile tires to powder in relatively large throughput volumes and relatively short time periods. The present invention provides a cost effective, easily maintained, automatically adjustable chopping, shredding and grinding machine capable of producing output particle and piece sizes of a relatively wide range. Furthermore, a machine constructed according to the present invention is a relatively low maintenance machine since, for example, it is also automatically and easily adjustable to accommodate wear of the grinding segments.

These and other objectives and advantages of the invention will become more readily apparent upon review of the following detailed description of the invention taken in conjunction with the accompanying drawings.

DETAILED DESCRIPTION OF THE PREFERRED EMBODIMENT

General Organization

Figure 1:
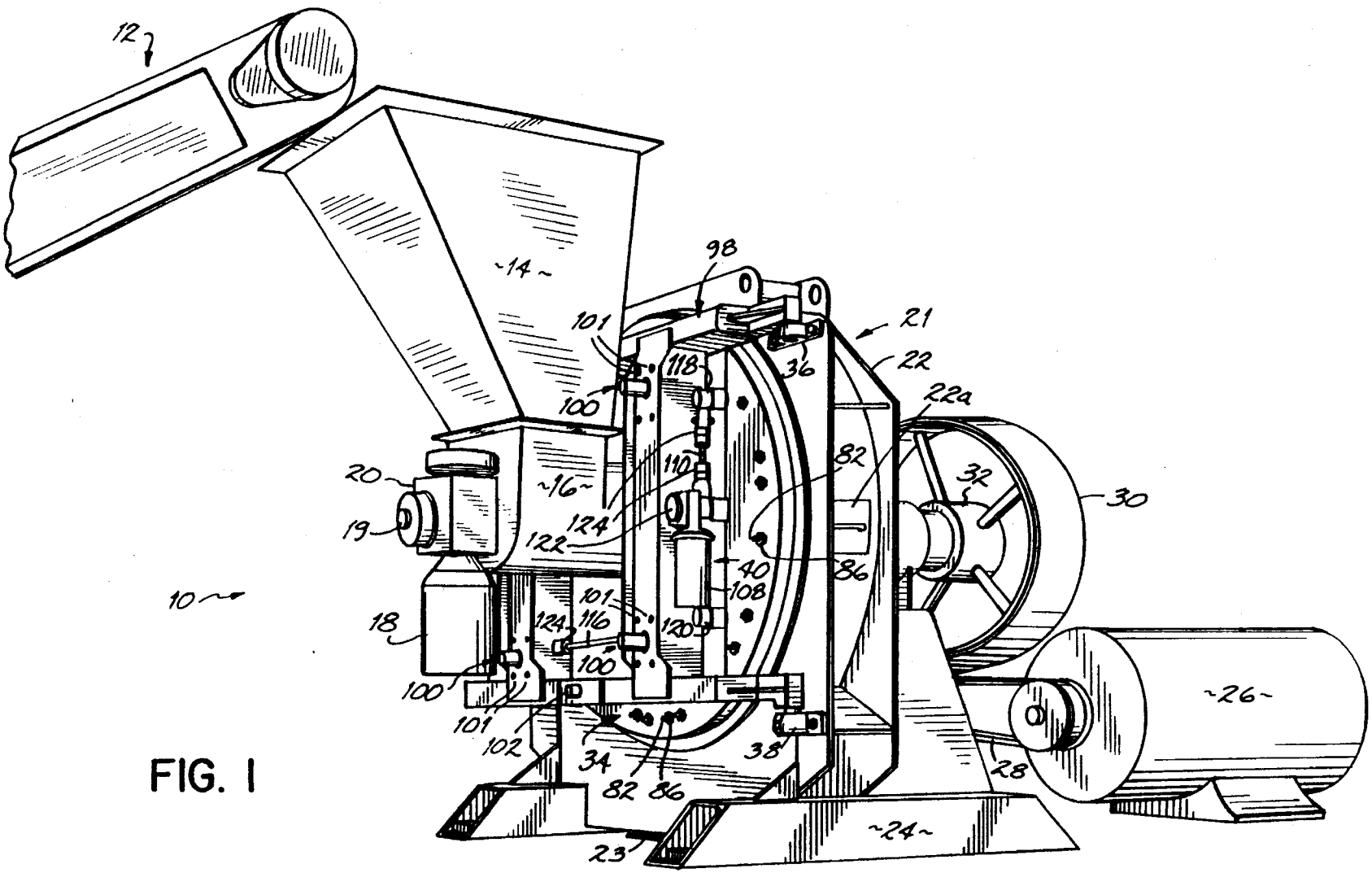
FIG. 1 is a diagrammatic perspective view of a grinding and chopping or shredding apparatus constructed according to the present invention.
Figures 2, 2A:
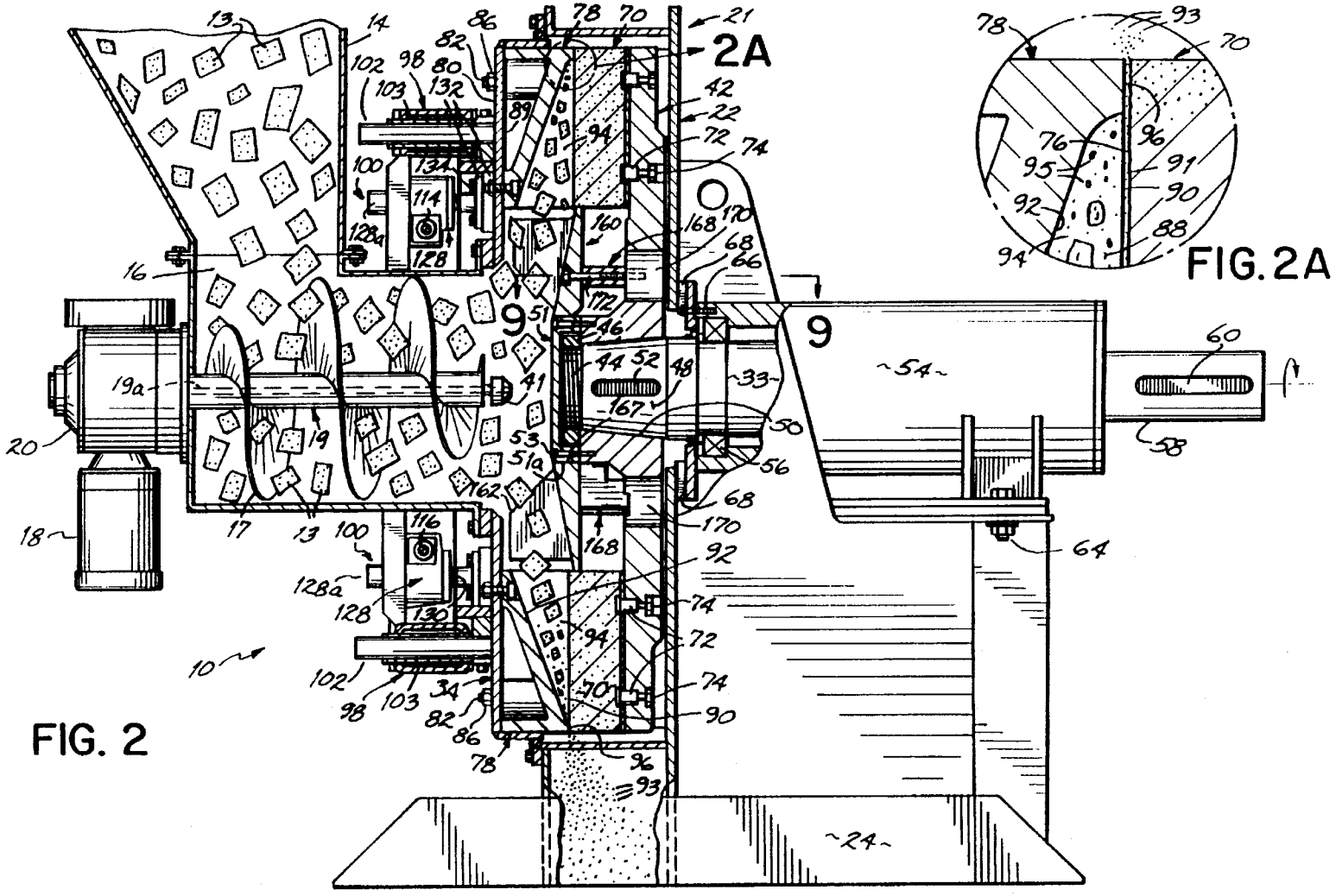
FIG. 2 is a front cross-sectional view of the apparatus taken along line 2—2 of FIG. 3.
FIG. 2A is an enlarged view of encircled portion 2A of FIG. 2.

Referring first to FIGS. 1 and 2, an apparatus 10 of the invention is shown and generally includes a conveyor 12 for conveying particulate material such as waste automobile tire pieces 13 into a feed hopper 14. The feed hopper 14 directs the material 13 into an inlet conduit 16 which houses a feed auger 17 rotated by a motor 18 through a right angle gear box 20. The inlet conduit 16 and feed auger 17 direct pieces 13 of material to be shredded or ground into the grinding chamber of a centrifugal grinder 21, explained in detail below. For simplicity, the term "centrifugal grinder" is used to refer to the indicated portion of the invention in the drawings in both its grinding and chopping or shredding forms. Centrifugal grinder 21 includes a housing 22 having a material outlet 23 and supported as free standing structure by a frame 24.

Referring specifically to FIG. 1, the centrifugal grinder 21 is operated by a 400 hp electric motor 26 having an operating speed of 1750 rpm. The motor 26 is operatively connected to the centrifugal grinder 21 by a speed reducing drive belt system including drive belts 28, 30 suitably interconnected by a way of a jack axle (not shown) which reduces the speed of the output shaft of motor 26 from 1750 rpm to about 325 rpm which is the speed of wheel 32. Wheel 32 is rigidly connected to drive shaft 33 of centrifugal grinder 21. As will be further explained below, a grinder drive shaft speed of 325 rpm translates into a speed of approximately 5000 ft/min. at the periphery of a rotating cutting (i.e., shredding or grinding) plate within housing 22.

Housing 22 further comprises a housing door 34 which is hinged at 36 and 38 to the housing 22 such that the grinding or chopping and shredding components contained therein may be accessed for maintenance, inspection and changeover purposes, as detailed below. Affixed to the outside of the housing door 34 is a gap adjustment mechanism 40 which is used to automatically set the gap between the grinding or chopping and shredding components of the centrifugal grinder 21 as also detailed below.

The Centrifugal Grinder

As illustrated in FIG. 2, feed auger 17 includes a shaft 19 having a rifle bore 19*a* extending longitudinally therethrough and an irrigation nozzle 41 affixed to an inner end thereof. Thus, a cooling fluid such as water may be directed through bore 19*a* and nozzle 41 to cool material 13 as it is either shredded or ground by centrifugal grinder 21. In its grinding form, centrifugal grinder 21 includes a rotatable grinding segment mounting plate or disk 42 disposed within housing 22 and mounted to one end of drive shaft 33. In this regard, drive shaft 33 is threaded at end 44 to receive an internally threaded shaft seal 46 which bears against an inside surface of the grinding segment mounting plate or disk 42 surrounding a central, tapered hole 50 in plate or disk 42. A portion 48 of drive shaft 33 spaced inwardly of the threaded section 44 has a taper which corresponds to the taper in the central hole 50. The tapered portion 48 of drive shaft 33 further includes a key way 52 which receives a key (not shown) extending inwardly from hole 50 in grinding segment mounting plate or disk 42. It will be appreciated that the mating tapers of tapered portion 48 and tapered hole 50 create a wedging effect which is maintained by shaft seal 46. A shaft end cover 51 is mounted over the threaded end of shaft 32 and rigidly secured to mounting plate or disk 42 by fasteners 53. The grinding segment mounting plate or disk 42 is rigidly secured to the drive shaft 32 and rotates therewith during a grinding or shredding operation.

Drive shaft 33 is mounted within a bearing housing 54 and, although only one of the bearings is shown in FIG. 2, is supported therein by bearings 56 at each end of housing 54. The opposite end 58 of drive shaft 32 is of reduced diameter and includes a key way 60 for enabling rigid attachment thereof to wheel 32 (FIG. 1). Bearing housing 54 is fastened to frame 24 by a plurality of suitable fasteners 64 and to housing 22 by suitable fasteners 66. For clarity, only one of each is shown in FIG. 2. A plurality of spacers 68 are preferably welded between two portions of housing 22, as shown in FIG. 2, and create air paths therebetween for ventilating grinder housing 22.

A plurality of, for example, twenty-four cutting members or, more specifically, grinding segments 70 are removably secured to the grinding segment mounting plate or disk 42 such that plate 42 serves as a rotating grinding plate, In this regard, each grinding segment 70 preferably includes two threaded inserts 72 rigidly secured to a rear side of the grinding segment 70 and adapted to receive threaded bolts 74 for mounting the grinding segments 70 to the grinding segment mounting plate or disk 42. Each grinding segment 70 is constructed from conventional grinding stone materials, Each grinding segment 70 is of equal thickness, with this thickness being preferably within the range of 3–4 inches, which is adapted to be gradually worn down during repeated grinding operations. Eventually, grinding segments 70 are removed and replaced as they are worn down by repeated grinding operations.

Figure 4:
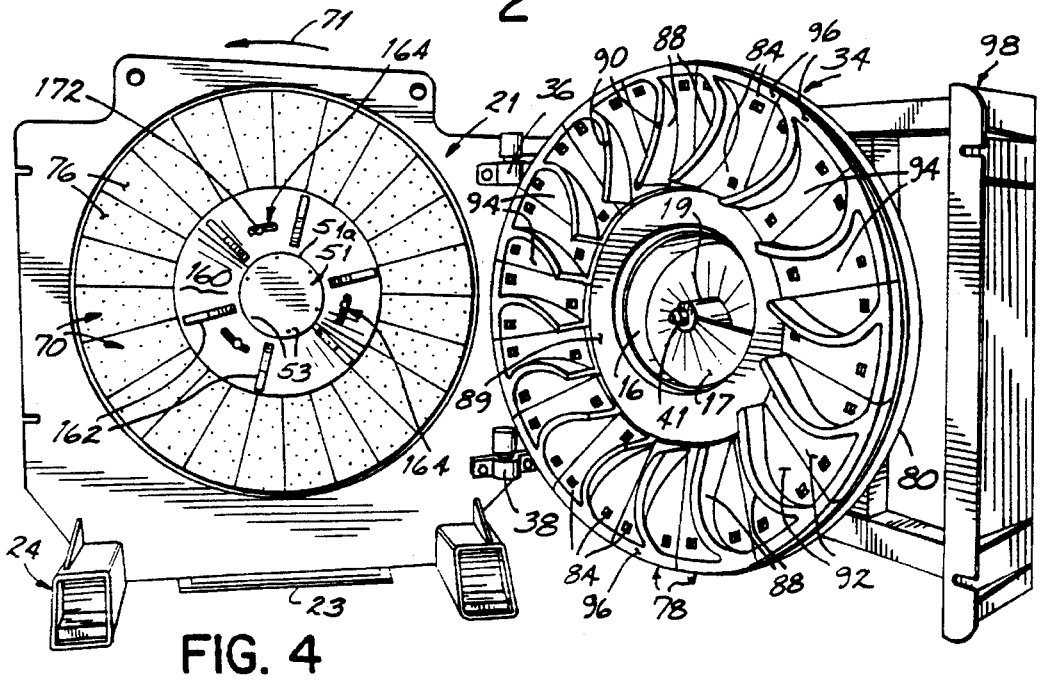
FIG. 4 is a perspective view showing the housing door open and the grinding components of the centrifugal grinder of the apparatus.
Figure 6:
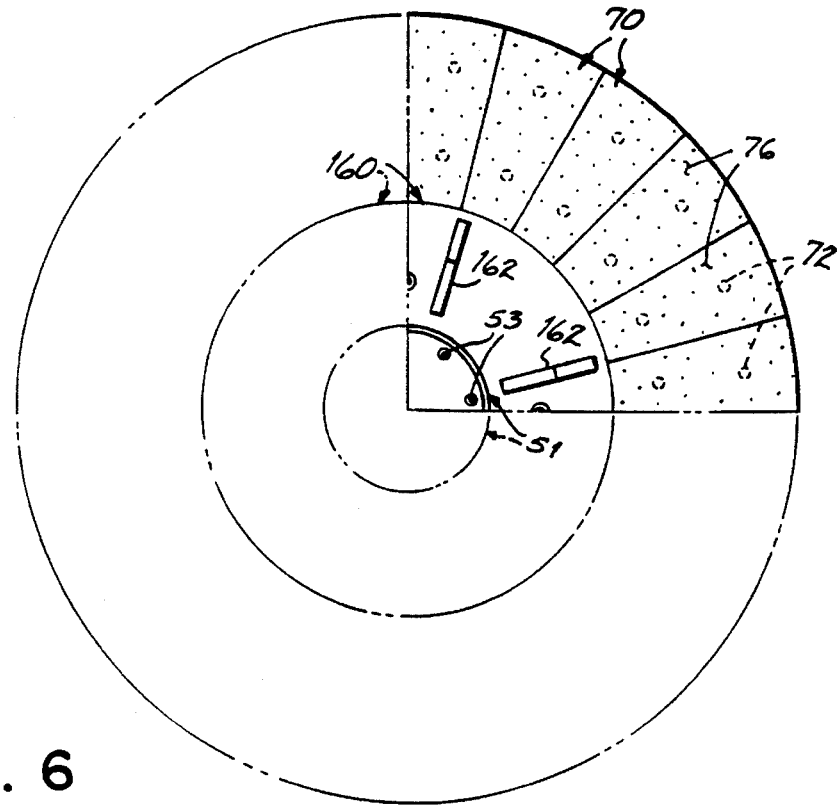
FIG. 6 is a diagrammatic front view showing a portion of the material distributing plate and the rotatable grinding segment mounting plate of the apparatus.

Referring now to FIG. 2 and FIG. 6, the grinding segments 70 are formed of equal thicknesses to create a flat but roughened or coarse annular grinding surface when all grinding segments 70 are mounted to plate or disk 42 (see FIG. 4), In other words, each of the grinding surfaces 76 on a macroscopic level are contained in generally the same plane so as to create a substantially continuous, flat annular grinding surface. As best shown in FIGS. 4 and 6, each segment 70 has a substantially trapezoidal shape as viewed from the grinding surface 76.

Figure 7:
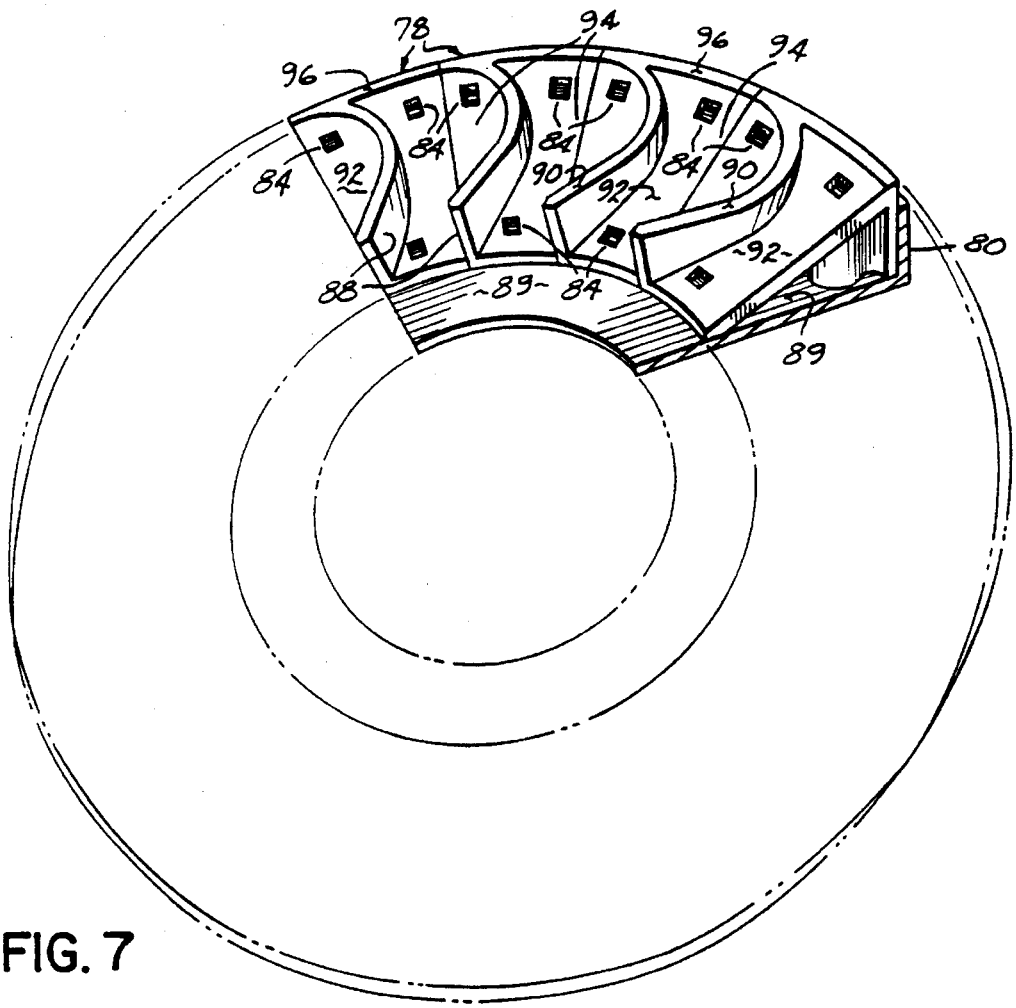
FIG. 7 is a diagrammatic perspective view showing a portion of the nonrotatable mounting plate of the invention as well as a segment of the removable, ribbed shearing plates mounted thereto.

As shown in FIGS. 2 and 7, housing 22 further contains a plurality of shearing plates 78 rigidly secured to a nonrotating mounting plate or disk 80 which comprises part of housing door 34. Specifically, as shown in FIG. 7, each shearing plate 78 is secured by way of 3 separate fasteners or bolts 82 (FIG. 2), having square heads which are received by square recesses 84 contained in shearing plates 78. The square recesses 84 prevent fasteners 82 from rotating as nuts 86 are threaded onto fasteners 82. Shearing plates 78 are thereby removably secured to mounting plate or disk 80. Each shearing plate 78 includes a rib 88 extending perpendicularly and generally radially with respect to an inner, flat surface 89 of mounting plate or disk 80 and each rib includes a planar outer edge surface 90 which is at least generally parallel to the flat grinding surface 76 of each grinding segment 70 as shown in FIG. 2.

As shown best in FIG. 2A, a small gap 91, which may comprise a gap of about 0.100" is created between the outer edge surfaces 90 of each rib 88 and the flat, but roughened or coarse grinding surface 76 of each grinding segment 70. It has been found that an average particle size of approximately 20 mesh (small enough to pass through a screen opening of 0.0331") may be produced using a gap of this size. It will be appreciated from FIG. 2A that the roughness or coarseness of grinding surface 76 may vary according to the application needs but surface 76 is generally comparable to the surface of sandpaper of comparable coarseness. In all cases, grinding surface 76 is planar on a macroscopic level. The size of gap 91, as shown in FIG. 2A, has been exaggerated from the ideal for clarity. Gap 91 is automatically adjustable in a manner described below and determines the size of the ground output particles 93. Like the outer grinding surfaces 76 of the grinding segments 70, the outer edge surfaces 90 of ribs 88 are each contained in a single, common plane and this plane is parallel to the plane which generally contains or defines grinding surfaces 76 of grinding segments 70 on a macroscopic level.

As best seen in FIGS. 2 and 7, shearing plates 78 further include a surface 92 which tapers toward the grinding segments 70 outwardly in a direction from a radially inwardly spaced section of mounting plate or disk 80 to a peripheral portion of mounting plate or disk 80. Therefore, the spaces between the grinding ribs 88, surfaces 92 and surfaces 76 of grinding segments 70 (FIG. 2) define grinding chamber segments 94 which taper in depth to gradually direct particulate material 95 contained therein in a radially outward direction and toward grinding segments 70 as it is ground. A peripheral edge surface 96 of each shearing plate 78 is contained in the same plane as edge surfaces 90 of ribs 88 and, when all plates 78 are secured to mounting disk 80, edge surfaces 96 of plates 78 together define a substantially continuous annular surface (FIG. 4) by which the particulate material must pass before exiting a grinding chamber segment 94. Thus, the gap 91 (FIG. 2A) between surface 96 and surfaces 76 of grinding segments 70 defines the maximum particle size which may pass out of grinding chamber segments 94, however, the average particle size exiting grinding chamber segments is generally much smaller than gap 91. Furthermore, each of the ribs 88 is curved or angled, as explained with respect to FIG. 4 below, such that they tend to pull material pieces 95 farther in a radially outward direction within a grinding chamber segment 94 such that pieces 95 are continuously ground and sheared into smaller particle sizes against surfaces 76 and between surfaces 90, 96 and surfaces 76 as they are centrifugally forced in a radially outward direction.

FIG. 4 shows centrifugal grinder 21 with the door 34 of housing 22 opened to illustrate the easy access thereby provided to easily inspect, repair or replace the components contained therein. For example, with door 34 opened, grinding segments 70 may be removed by unthreading bolts 74 from the outside of housing 22 by way of one or more covered access ports (not shown) in the side of housing 22 facing drive shaft 33. At least one covered access port 22*a* (FIG. 1) may also be included in the side of housing 22 to assist in the removal of grinding segments 70 or for inspection purposes, etc. The axial position of material distributing plate 160 may also be easily adjusted when door 34 is open. As perhaps also best shown by FIG. 4, the direction of rotation of grinding segments 70 (indicated by arrow 71) or of the optional chopping and shredding knives 136, described below, works in conjunction with the curvature and angling of shearing plate ribs 88 to force material in a radial outward direction during a chopping or grinding operation. In this regard, starting at the radial inward end thereof, each rib curves or angles first generally in the direction of rotation 71 and then against the direction of rotation 71.

The Gap Adjustment Mechanism

Figure 3:
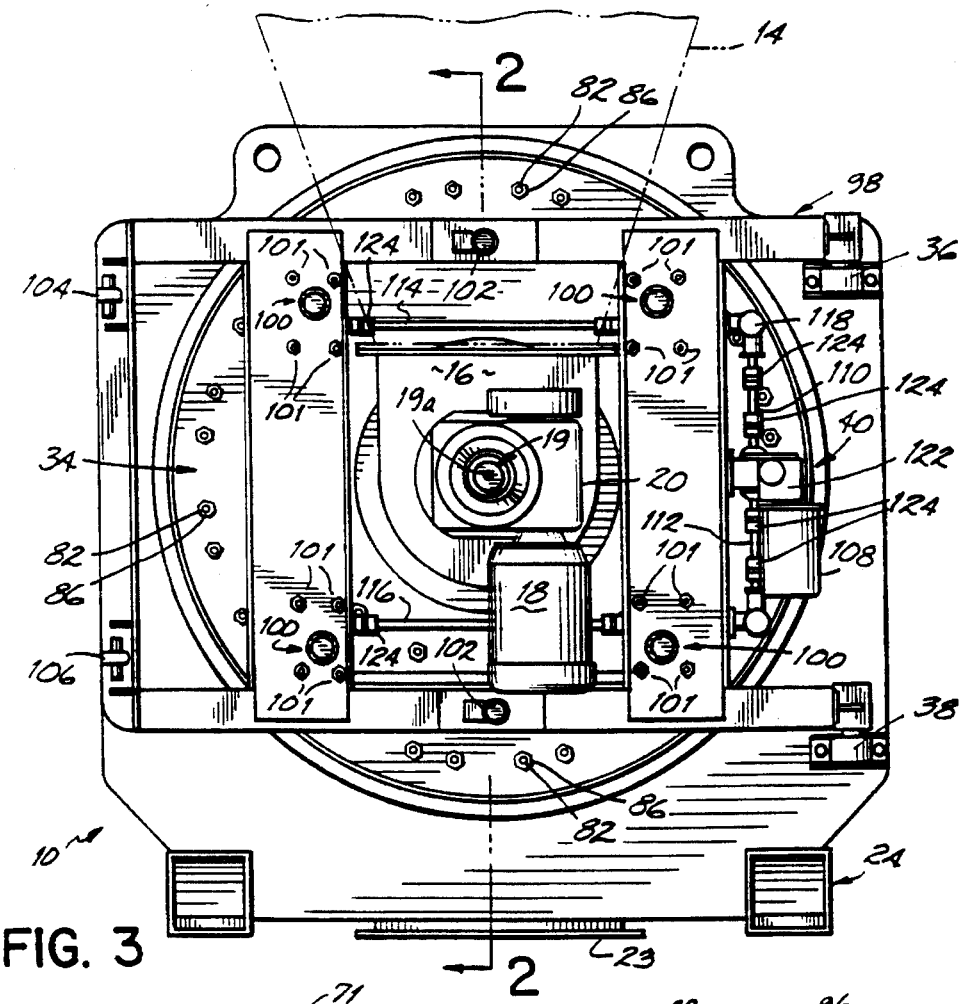
FIG. 3 is a front elevational view of the housing door and attached gap adjustment mechanism of the apparatus.

Turning now to FIGS. 2 and 3, housing door 34 is supported on a door frame 98 by four screw jack assemblies 100 and two horizontal guide pins 102. The screw jack assemblies 100 are rigidly secured to door frame 98 by suitable fasteners 101. The door frame 98 is hinged to the main frame 24 of apparatus 10 by a pair of hinges 36, 38 as mentioned above. A pair of latches 104, 106 on the opposite side of the door frame 98 are used to maintain the door in a closed position. Latches 104, 106 may, for example, comprise toggle bolts. The four screw jack assemblies 100 comprise part of the gap adjustment mechanism 40 which automatically moves nonrotating mounting disk 80 back and forth in an axial direction to set the proper gap between the shearing plates 78 and grinding segments 70. Each screw jack assembly 100 preferably comprises a worm gear driven unit sold under the trade name Machine Screw Actionjack™ and manufactured by Nook Industries. The gap adjustment mechanism 40 further comprises a gear motor 108 connected to a series of shafts 110, 112, 114, 116 which are interconnected by way of two right angle gear boxes 118, 120 and a gear box 122 associated with gear motor 108. Couplings 124 are further used to connect various shaft segments of shafts 110, 112, 114, 116 together and to make connections to screw jack assemblies 100, right angle gear boxes 118, 120 and gear box 122.

The screw jack assemblies 100 are conventional in construction and therefore are not shown in great detail. Generally, and as shown best in FIG. 2, each screw jack 100 is identical and comprises a housing 128 which houses a linearly movable screw 130. A worm in each housing 128 is rotated by the respective shaft 114 or 116 and in turn rotates a ring shaped worm gear mounted within housing 128. The worm gear is internally threaded to mate with the threads of screw 130 such that rotation of the worm gear moves the screw 130 linearly with respect to the housing 128 in a nonrotating fashion. Each screw jack housing 128 includes a portion 128*a* which accommodates screw 130 therein. Each screw 130 is further rigidly secured to the grinding plate mounting disk 80 by mounting plates or flanges 132 and fasteners 134. It will be appreciated that simultaneous linear movement of screws 130 of each screw jack 100 will cause movement of mounting plate or disk 80 and its attached shearing plates 78 in an axial direction to vary the gap between grinding surfaces 76 of grinding segments 70 and the outer edge surfaces 90, 96 of shearing plates 78. Upper and lower guide pins 102 rigidly mounted to mounting disk 80 slide within bushings 103 rigidly mounted to door frame 98 to support the grinding plate mounting disk 80 and all attached structure moving therewith as a gap adjustment is made.

Figure 13:
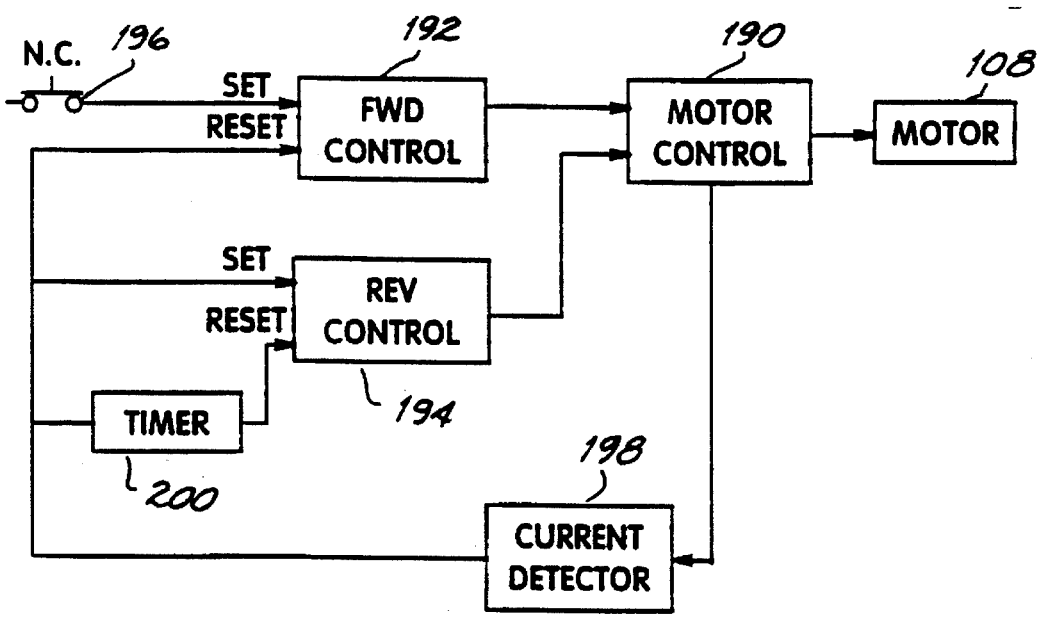
FIG. 13 is block diagram showing the control system for the automatic gap adjustment mechanism of the apparatus.

The control system for the automatic gap adjustment mechanism 40 is shown in the block diagram of FIG. 13. In this regard, FIG. 13 shows gear motor 108 connected to a motor control 190 which includes inputs from a forward control 192 as well as a reverse control 194. In operation, a normally closed switch 196 closes whenever the main power to the apparatus 10 is turned off. Closure of switch 196 sets the forward control 192 and starts gear motor 108 through the motor control 190 in a forward direction. Movement of motor 108 in a forward direction moves plate 80 and attached shearing plates 78 axially toward plate 42 which is axially fixed. This movement occurs by way of the four screw jack assemblies 100 as previously explained. A current detector 198, which may be a model ECS61BC marketed by SSAC, Inc., is operatively connected to motor control 190 and detects a rise in current when surfaces 90, 96 of shearing plates 78 contact or abut either surfaces 76 of grinding segments 70 or surfaces 137 of knives 136 depending on whether a grinding operation or a chopping and shredding operation is being performed with apparatus 10. Once contact is made between these components axial movement of plate 80 will stop and the current load on motor 108 will begin to rise. When a threshold current value is reached, this current value is detected by current detector 198 and forward control 192 is reset while the reverse control 194 is set. Setting of reverse control 194 sends a signal to motor control 190 to reverse motor 108 and thereby back shearing plates 78 off from grinding segments 70 or knives 136 until a timer 200 times out. At this time, reverse control 194 is reset and the motor 108 is stopped thus stopping axial movement of plate 80. The amount of time that the motor 108 is reversed is preferably adjustable and corresponds to the desired gap 91 (FIG. 2A) between shearing plate surfaces 90, 96 and surfaces 76 of grinding segments 70 or surfaces 137 of knives 136. Of course, a counting mechanism for counting the number of rotations of the output shaft of motor 108 may alternatively be provided in the control system instead of timer 200. In this regard, the direct relationship between the number of rotations of the motor shaft and the linear movement of screws 130 would be used by the control system to set the gap 91. It will also be understood by those of ordinary skill that the threshold current value detected by current detector 198 will be dictated by other parameters of the control system and will, in all cases, be lower than a value which overloads motor 108.

The Chopping and Shredding Apparatus

Figure 5:
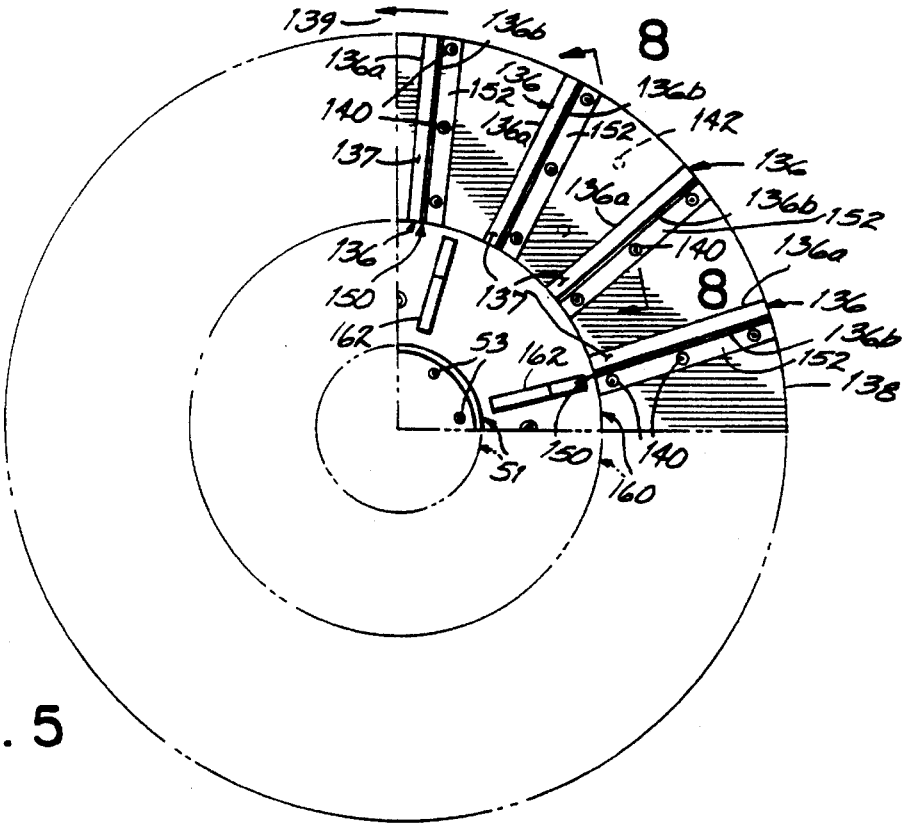
FIG. 5 is a diagrammatic front view showing a portion of the material distributing plate as well as the rotatable mounting plate for the chopping and shredding knives of the apparatus.

FIG. 5 illustrates the optional use of a plurality of cutting members which more specifically take the form of radially extending knives 136 in place of grinding segments 70 to convert apparatus 10 into a chopping and shredding machine. The knives 136 are removably fastened to a knife mounting plate or disk 138 by threaded fasteners 140. The knife mounting plate or disk 138 is removably fastened to the grinding segment mounting plate or disk 42 by fasteners 142 after the grinding segments 70 have been removed. Thus, in this embodiment plate 42 serves as a rotating chopping and shredding plate or disk. Each knife 136 has a smooth, planar outer edge surface 137 which, in use, is parallel to the outer edge surfaces 90, 96 of shearing plates 78 and directly adjacent and opposed thereto. Furthermore, with the direction of rotation being counterclockwise as viewed from the front of knife mounting plate or disk 138 and indicated by arrow 139, each knife 136 includes a straight leading edge **136*a* and a straight trailing edge 136*b*. Shredding of material 13 takes place through shearing action between leading edges 136*a* rotating with respect to ribs 88 of shearing plates 78** (FIG. 7).

Figure 2B:
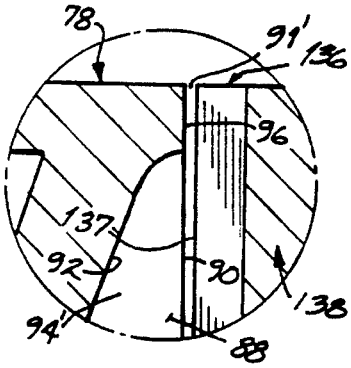
FIG. 2B is an enlarged view similar to FIG. 2A but showing a chopping and shredding knife replacing the grinding segment of FIG. 2A.

Referring now to FIG. 2B, a gap 91' is created between the outer edge surfaces 90, 96 of each shearing plate 78 and the planar outer surface 137 of each chopping and shredding knife 136. Gap 91' is typically smaller than gap 91 which is set when grinding segments 70 are used in place of knives 136. Gap 91' is automatically adjustable in a manner described below and must be kept to a minimum for optimum shearing or shredding efficiency. A preferred gap for shredding automobile tires has been found to be approximately 0.003"–0.005". As further shown in FIG. 2B, similar to the grinding chamber segments 94 created when grinding segments 70 are used, a chopping and shredding space 94' is created generally between plate 138 and tapered surfaces 92 of shearing plates 78. The chopping and shredding operation takes place within space 94' as the tapered surface 92 directs material toward the shearing knives 136 and centrifugal force causes the material to be forced in a radial outward direction, i.e., an upward direction as viewed in FIG. 2B. Like the outer grinding faces 76 of the grinding segments 70 and the outer edge surfaces 90, 96 of shearing plates 78, outer edge surfaces 137 of each knife 136 are each contained in a single, common plane when knives 136 are affixed to plate 138 and this plane is at least generally parallel to the plane which defines surfaces 90, 96.

Figure 8:
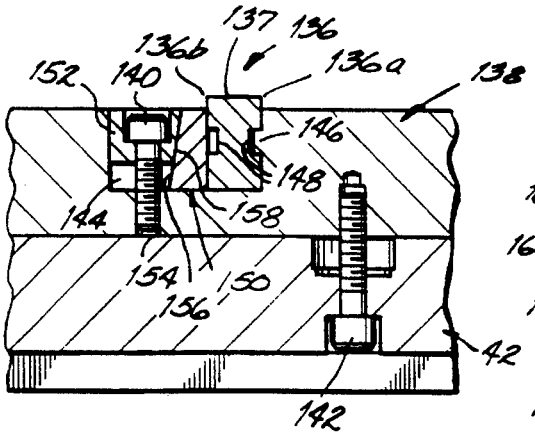
FIG. 8 is a cross-sectional view taken along line 8—8 of FIG. 5 and showing the preferred means for fastening the individual chopping and shredding knives to the knife mounting plate as well as the fastening means between the knife mounting plate and the rotatable mounting plate.

Turning now to FIG. 8, the manner of affixing knives 136 to knife mounting plate 138 is shown. In this regard, each knife 136 is received by a radially extending slot or recess 144 having a radially extending key 146 protruding from a side wall thereof and received by a key way 148 formed in a knife 136. Key ways 148 are formed on each longitudinal side of knives 136 to enable knives 136 to be turned around such that the leading edge **136*a* becomes the trailing edge 136*b* and vice versa. This effectively doubles the lives of the leading edges 136*a* of knives 136 since both edges 136*a*, 136*b* can be used as leading or cutting edges. This is advantageous as leading edges 136*a*** tend to become worn during repeated grinding operations.

First and second wedge members 150, 152 are further received within slot or recess 144 and serve to firmly wedge the respective knives 136 within recess 144 when fasteners 140 are tightened down into threaded holes 154 in knife mounting plate 138. It will be appreciated that as the fasteners 140 are tightened down, wedge member 150 is pushed against knife 136 and key 146 is firmly pushed into key way 148 due to the wedging action of tapered surfaces 156, 158. Specifically, as wedge member 152 moves downwardly into recess 144, tapered surface 158 thereof slides downwardly on tapered surface 156 of wedge member 150 and thereby urges wedge member 150 against knife 136. It has been found that this method of fastening knives 136 to knife mounting plate 138 provides a very rigid mounting for knives 136 and substantially eliminates any vibration thereof during chopping and shredding operations.

It will be appreciated that when knives 136 are used in place of grinding segments 70, gap adjustment mechanism 40 may be operated in exactly the same way as mentioned above. As mentioned above, a gap 91' of about 0.003"–0.005" has been found to be optimal for shredding 3"–4" automobile tire pieces into a size range of approximately ½"–1". Other factors, such as the speed of rotation of mounting plate 138, the number of knives 136 and the distance between surfaces 90, 96 and the outer surface of plate 138 will also affect the output product size. Gap 91" is created with the control system detailed above with the only difference being that knife surfaces 137, rather than grinding surfaces 76, abut or contact surfaces 90, 96 of plates 78 during the adjustment procedure.

The Adjustable Material Distributing Plate

Figure 9:
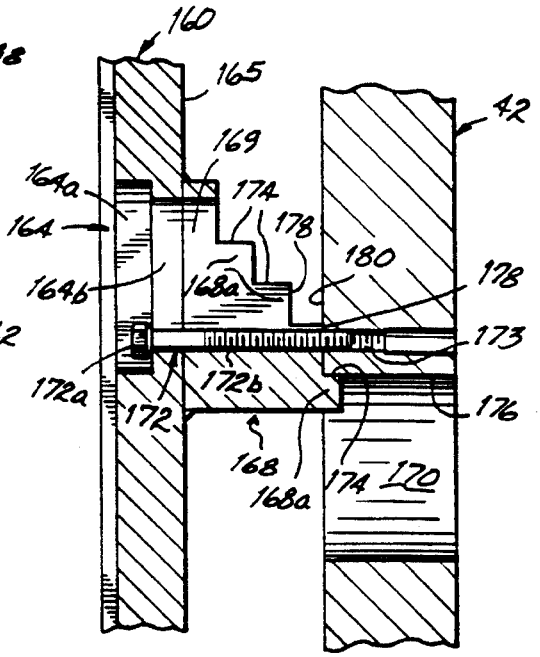
FIG. 9 is a cross-sectional view taken along line 9—9 of FIG. 2 and showing the adjustable fastening means for the material distributing plate.
Figure 10:
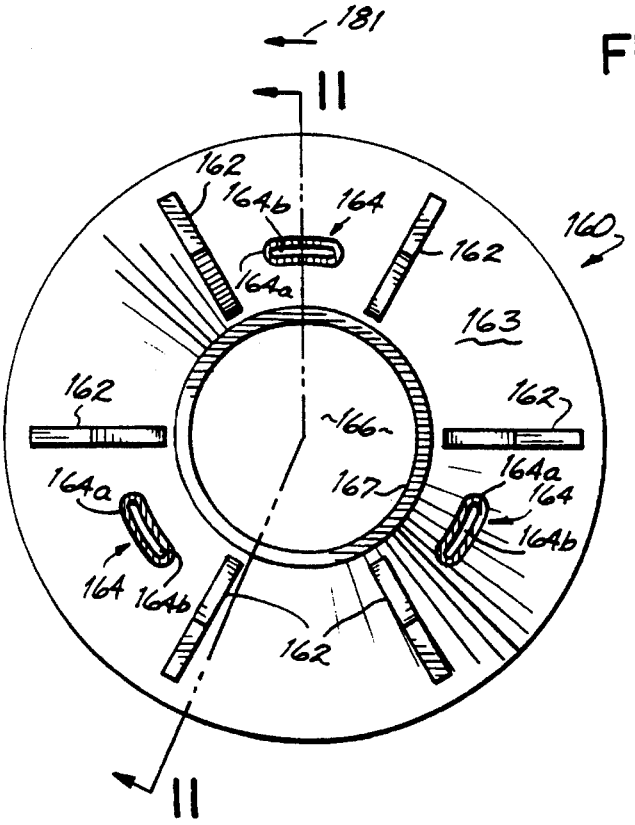
FIG. 10 is a front elevational view of the material distributing plate.
Figure 11:
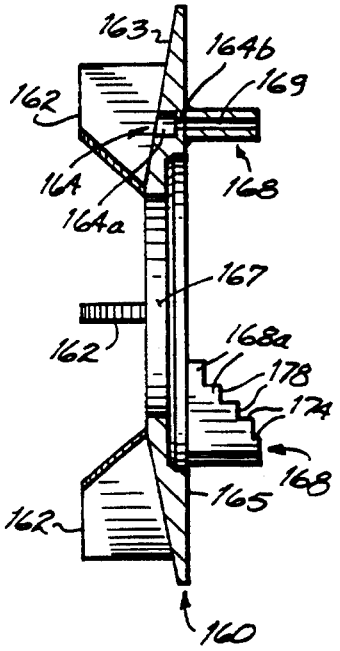
FIG. 11 is a cross-sectional view of the material distributing plate taken along line 11—11 of FIG. 10.

FIGS. 2 and 9–12 illustrate the material distributing plate 160 of the apparatus 10 which is used to distribute material 13 radially outwardly and into grinding chamber segments 94 or chopping and shredding space 94' (FIG. 2B) as it rotates with mounting plate or disk 42. As shown in FIGS. 10 and 11, material distributing plate 160 includes a plurality of fins 162 extending outwardly from a front surface 163 of plate 160. A plurality of, for example, three adjustments slots 164 extend through the plate 160 and are preferably curved such that the respective radii of their curvatures are centered at the center of plate 160 or, in other words, at the axis of rotation of plate 160. Each curved adjustment slot 164 includes a counterbored or stepped portion 164*a* opening to the front surface 163 of plate 160. The counterbored or stepped portion 164*a* receives the head of a fastener to rigidly secure plate 160 to plate 42, as described below, and a narrower slot 164*b* extends through to the rear surface 165 of plate 160. Material distributing plate 160 further includes a central mounting hole 166 which also has its center located coincident with the axis of rotation or center point of plate 160.

Referring specifically to FIG. 2, the central hole 166 receives the shaft end cover 51 with a slight clearance gap (not shown) maintained between the outside peripheral surface 51*a* of end cover 51 and surface 167 of plate 160 which defines central hole 166. As detailed below, this allows relative rotation between material distributing plate 160 and mounting plate 42 when axial adjustment of plate 160 is necessary.

Figure 12:
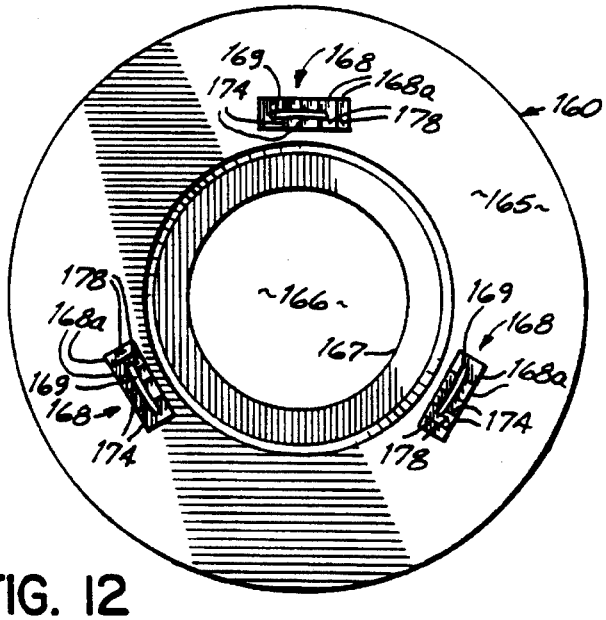
FIG. 12 is a rear elevational view of the material distributing plate.

As best shown in FIGS. 9, 11 and 12, material distributing plate 160 further includes a plurality of stepped adjustment blocks 168 which are each rigidly mounted, as by welding, to rear surface 165 of plate 160 and which each include a plurality of right angle steps 168*a* each defining a different axial position for distributing plate 160. Each block 168 further includes a curved slot 169 extending therethrough. Slots 169 correspond in curvature to the curved adjustment slots 164 of plate 160. Slots 169 of stepped adjustment blocks 168 lie directly over the through slot portions 164*b* of curved adjustment slots 164 and are of the same width and curvature as through slot portions 164*b* of slots 164. Mounting plate or disk 42 includes three circular holes 170 extending therethrough and located approximately at the same angular and radial positions with respect to drive shaft 33 as the stepped adjustment blocks 168 as shown best in FIG. 2.

FIG. 9 shows the specific manner of attaching material distributing plate 160 to mounting plate or disk 42. It will be appreciated that the desired step or steps 168*a* of the three stepped mounting blocks 168 seat within the three respective mounting bores 170 of the mounting plate or disk 42 in the same manner and therefore only one such connection is shown and described herein. Threaded fastener 172 includes a head portion 172*a* and a threaded portion 172*b*. The head portion 172*a* is received within the counterbored or stepped slot portion 164*a* of curved adjustment slot 164 while the threaded portion 172*b* is received within the through slot portion 164*b* as well as the matching curved slot 169 within stepped adjustment block 168. Threaded portion 172*b* is threaded into a threaded hole 173 in mounting plate or disk 42. When the 15 stepped adjustment block 168 is properly mounted against mounting plate or disk 42, a surface 174 of one step 168*a* is held firmly in contact with surface 176 of mounting hole 170 while a perpendicularly oriented surface 178 of the adjacent, lower step 168*a* is held firmly against surface 180 of mounting plate or disk 42. Thus, when fastener 172 is tightened down, surfaces 174 and 178 of two adjacent steps 168*a* bear against respective surfaces 176 and 180 of mounting plate or disk 42. From the perspective of FIG. 9, the rotation of mounting plate or disk 42 and of material distributing plate 160 would generally be indicated in a downward direction or, from the perspective of FIG. 10, in a counterclockwise direction as indicated by arrow 181. It will be appreciated best from FIG. 9 then that surfaces 174 of steps 168*a* provide load bearing surfaces for bearing the forces generated against adjustment blocks 168 by rotation of mounting plate or disk 42.

The axial position of material distributing plate 160 is adjusted by first opening housing door 34 as shown in FIG. 4 and then removing fasteners 172 from threaded holes 173 in plate 42. As viewed from the front of plate 160 shown in FIGS. 4 and 10, plate 160 is then rotated manually, for example, in a counterclockwise direction as plate 160 is rotatably supported on shaft end cover 51 by way of surface 167 being rotatably supported on the top of surface 51*a* of shaft end cover 51 (FIGS. 2 and 4). The material distributing plate 160 is manually rotated until the desired steps 168*a* of each stepped mounting block 168 are seated properly with respect to mounting hole 170 of plate 42. It will be appreciated that each stepped adjustment block 168, and the steps 168*a* associated therewith, is dimensioned exactly the same. Thus, when plate 160 is properly mounted to plate 42, the same relative steps 168*a* of each block 168 will be firmly seated against surfaces 176 and 180 of plate 42.

Material distributing plate 160, as shown in FIG. 9, is fastened in its outermost axial position with respect to mounting plate or disk 42 or, in other words, with the outermost or "highest" step 168*a* of each block 168 extending into a respective mounting hole 170 in plate 42. To move the material distributing plate 160 axially toward the mounting plate or disk 42, fasteners 172 are removed and each stepped mounting block 168 would be inserted farther into mounting hole 170 by sequentially inserting lower or more inwardly disposed steps 168*a* into holes 170 by manual, counterclockwise rotation of material distributing plate 160 with respect to plate 42 until the desired axial position of plate 160 is achieved. This would be necessary, for example, if grinding segments 70 have been significantly worn down. After the adjustment is made, a different surface 174 and a different surface 178 than those shown seated against surfaces 176, 180 in FIG. 9 will be respectively seated against surfaces 176 and 180. The fasteners 172 are then again threaded into holes 173 and tightened down. It will be appreciated that the size and number of steps 168*a* on blocks 168 may be varied according to the adjustment needs of particular applications, however, each block must nevertheless be identically dimensioned.

Operation

Before apparatus 10 is operated to shred or grind material, housing door 34 is opened and either grinding segments 70 are attached to plate 42 or plate 138 is attached to plate 42 and chopping and shredding knives 136 are attached to plate 138, as previously described, depending on the desired operation. Material distributing plate 160 is then axially adjusted, if necessary, with respect to grinding segments 70 or knives 136 such that the peripheral edge of front face 163 is approximately even with grinding surface 76 (as shown in FIG. 2) or outer surfaces 137 of knives 136. The door 34 is then closed and latched and the main power to apparatus 10 is turned ON. This opens normally closed switch 196 of the control system for gap adjustment mechanism 40 (FIG. 13). As explained above, gap adjustment mechanism 40 sets the proper gap 91 (FIG. 2A) or gap 91" (FIG. 2B) between surfaces 90 of ribs 78 and surfaces 76 of grinding segments 70 or between surfaces 90 and surfaces 137 of knives 136 as the case may be. Ideally, this gap adjustment was made when the main power to apparatus 10 was turned OFF after the previous operation of apparatus 10 as explained above. It will be appreciated by those of ordinary skill that a manual override may also be provided in the control system such that gap adjustment mechanism may be operated at any time that plate 42 is not rotating. This may be necessary in the situation where a changeover is made between grinding segments 70 and knives 136, for example, or when a change in gap 91 is desired for any other reason while the main power to apparatus 10 is turned ON.

Referring now to FIG. 2, material such as waste automobile tire pieces 13 is fed into feed hopper 14 and inlet conduit 16. Motor 18 continuously rotates auger 17 through right angle gear box 20 such that material 13 is constantly fed into the centrifugal grinder 21. Pressurized coolant, such as water, may be directed through shaft 19 of auger 17 by way of bore 19*a*, as necessary, and forced out of nozzle 41 and into the centrifugal grinder 21. Motor 26 (FIG. 1) rotates drive shaft 33 through a speed reduction belt system 28, 30 as previously mentioned, at a speed of approximately 325 rpm. At this speed, the circular rotatable mounting plate or disk 42, which has a diameter of approximately 5 feet, has a peripheral tip speed of approximately 5,000 ft/min. Thus, referring now to FIG. 2A, the speed of the outermost peripheral portions of the grinding segments 70 which are directly opposed to surfaces 96 of shearing plates 78 are moving with respect thereto at a speed of approximately 5,000 ft/min. Of course, the same relationship is established between chopping and shredding knives 136 and shearing plates 78.

The centrifugal force created by the rotating mounting plate or disk 42 forces material pieces 13 farther and farther in a radial outward direction within grinding chamber segments or spaces 94, 94' such that they are ground into smaller and smaller material pieces 95, as shown in FIG. 2A, until they reach the outermost extent of shearing plates 78 and grinding segments 70 whereupon they are ground into output particles 93 of a size sufficiently small to exit the grinding chamber segments 94 through gap 91 output particles 93 are preferably 20–100 mesh in size. Output particles 93 are directed into material outlet 23 located at the bottom of the centrifugal grinder 21 either by gravity or by an air assist or vacuum pressure which may be operatively connected to outlet 23. The same general operation occurs during shredding as well except that larger pieces of material result. When the grinding or shredding operation is complete, the main power to apparatus 10 is turned OFF. This turns off motors 18 and 26 and, as previously explained, starts the automatic gap adjustment mechanism 40 to again set the proper, predetermined gap 91, or 91" for the next grinding or shredding operation.

It will be appreciated that although a preferred embodiment of the invention has been fully described herein, those of ordinary skill in the art will readily recognize many modifications and substitutions which are fully within the scope of the invention. For example, although the present invention has been described with the grinding segments or knives being rotated with respect to the shearing plates, the opposite relationship may instead exist wherein the shearing plates rotate and the grinding segments or knives remain stationary. As another alternative, both the grinding segments or knives and the shearing plates may be rotated in opposite directions with respect to one another. In addition, modifications to the gap adjustment control system will be readily recognized by those of ordinary skill and may include other types of sensors than the current sensor disclosed herein. Still further modifications and substitutions will become readily apparent to those of ordinary skill in the art and applicant therefore intends to be bound only by the scope of the claims appended hereto.

What is claimed is:

1. Centrifugal grinding apparatus comprising:

a housing including an inlet and an outlet;

a first plate secured within said housing and including a plurality of generally radially extending ribs, each of said ribs having an outer edge surface;

a grinding plate mounted within said housing and including a roughened grinding surface directly opposed and adjacent to said outer edge surfaces of said ribs but spaced away from said outer edge surfaces of said ribs by a predetermined gap thereby generally defining grinding chamber segments between said ribs of said first plate and said grinding surface, said inlet and said outlet communicating with said grinding chamber segments;

wherein one of said first plate and said grinding plate is mounted for rotation within said housing and a motor is operatively coupled to said one plate for rotating said one plate during a grinding operation.

2. The apparatus of claim 1 wherein said outer edge surfaces of said ribs lie in a common plane.

3. The apparatus of claim 2 wherein said grinding plate includes a plurality of grinding segments removably attached thereto, each grinding segment having an outer grinding surface defining a portion of said roughened grinding surface.

4. The apparatus of claim 1 wherein said grinding plate includes a plurality of grinding segments removably attached thereto, each grinding segment having an outer grinding surface defining a portion of said roughened grinding surface.

5. The apparatus of claim 4 wherein said roughened grinding surface generally lies in a plane parallel to said common plane defined by the outer edge surfaces of said ribs.

6. The apparatus of claim 5 wherein said grinding surface is annularly shaped.

7. The apparatus of claim 1 wherein said grinding surface is annularly shaped.

8. The apparatus of claim 1 wherein said ribs are disposed on a plurality of shearing plates removably attached to said first plate.

9. The apparatus of claim 1 wherein said grinding plate is mounted for rotation within said housing.

10. Centrifugal chopping and shredding apparatus comprising:

a housing including an inlet for receiving material to be shredded and an outlet for discharging shredding material;

a first plate secured within said housing and including a plurality of generally radially extending ribs thereon, each said ribs extending upwardly from a radially outwardly and upwardly inclined surface and having an outer edge surface extending radially outwardly to a substantially continuous peripheral surface of said first plate;

a chopping and shredding plate mounted within said housing and including a plurality of radially extending knives protruding from one face thereof, said knives directly opposing said ribs and including a radially outer portion directly opposed to said substantially continuous outer surface, said knives further being spaced away from said outer edge surfaces of said ribs and said substantially continuous outer surface by a predetermined gap, and said inlet and said outlet communicating with a space disposed between said first plate and said chopping and shredding plate;

wherein one of said first plate and said chopping and shredding plate is mounted for rotation within said housing and a motor is operatively coupled to said one plate for rotating said one plate during a chopping and shredding operation.

11. The apparatus of claim 10 wherein said outer edge surfaces of said ribs lie in a common plane.

12. The apparatus of claim 10 wherein said knives are each separately and removably affixed to said chopping and shredding plate.

13. The apparatus of claim 10 wherein said knives include outer edge surfaces lying in a common plane and disposed in opposed relation to said outer edge surfaces of said ribs.

14. The apparatus of claim 10 wherein said ribs are disposed on a plurality of shearing plates removably attached to said first plate.

15. The apparatus of claim 10 wherein said chopping and shredding plate is mounted for rotation within said housing.

16. Apparatus for grinding or shredding material comprising:

a housing including an inlet and an outlet;

a first plate secured within said housing and including a cutting surface;

a surface plate mounted for rotation within said housing, said second plate including a cutting surface, wherein said cutting surfaces of said first and second plates are opposed to one another and a space is defined therebetween, said inlet and said outlet communicating with said space;

one of said first plate and said second plate being mounted for rotation within said housing;

a material distributing plate mounted for rotation within said housing and radially disposed between said space and said inlet, said material distributing plate being mounted to said second plate and axially adjustable with respect to said second plate; and at least one motor operatively coupled to said one plate and said material distributing plate for rotating said one plate and said material distributing plate.

17. The apparatus of claim 16 wherein said material distributing plate includes a plurality of fins extending outwardly at angularly spaced locations from an inner surface thereof.

18. The apparatus of claim 16 wherein a plurality of curved adjustment slots extend through said material distributing plate at angularly spaced locations thereof and said material distributing plate further comprises a plurality of stepped adjustment blocks rigidly affixed thereto proximate said adjustment slots and a plurality of fasteners extending through said slots to secure said material distributing plate to said second plate such that a first step of each stepped adjustment block bears against a portion of said second plate, whereby removal of said fasteners allows said material distributing plate to be axially adjusted with respect to said second plate and affixed in a new axial location by securing said fasteners to said second plate with another step of said stepped adjustment block bearing against said portion of said second plate.

19. The apparatus of claim 16 wherein said second plate is a grinding plate including a roughened grinding surface.

20. The apparatus of claim 19 wherein said grinding surface is annularly shaped and said material distributing plate is mounted centrally of said grinding surface.

21. The apparatus of claim 19 wherein said grinding plate includes a plurality of grinding segments removably attached thereto, each grinding segment having an outer grinding surface defining a portion of said roughened grinding surface.

22. The apparatus of claim 16 wherein said cutting surface on said first plate comprises a plurality of generally radially extending ribs.

23. The apparatus of claim 22 wherein outer edge surfaces of said ribs lie in a common plane.

24. The apparatus of claim 23 wherein said cutting surface of said second plate generally lies in a plane parallel to said common plane defined by the outer edge surfaces of said ribs.

25. The apparatus of claim 16 wherein said cutting surface of said second plate comprises a plurality of radially extending knives extending outwardly toward said cutting surface of said first plate.

26. The apparatus of claim 25 wherein said cutting surface on said first plate comprises a plurality of generally radially extending ribs.

27. The apparatus of claim 26 wherein outer edge surfaces of said ribs lie in a common plane.

28. The apparatus of claim 25 wherein said knives are removably affixed to said second plate.

29. Apparatus for grinding or shredding material comprising:

a housing including an inlet and an outlet;

a first plate secured within said housing and including a cutting surface;

a second plate mounted within said housing, said second plate including a cutting surface, wherein said cutting surfaces of said first and second plates are opposed to one another and a space is defined therebetween, said inlet and said outlet communicating with said space;

one of said first plate and said second plate being mounted for rotation within said housing and operatively coupled to a motor for rotating said one plate;

the other of said first and second plates being axially adjustable with respect to said one plate; and, a control mechanism operatively coupled to said other plate and which moves said other plate axially toward said one plate until said cutting surfaces contact one another and then moves said other plate away from said one plate a predetermined distance.

30. The apparatus of claim 29 wherein said control mechanism further comprises a gear motor operatively coupled to a plurality of screw jacks, wherein a movable screw portion of each screw jack is connected to said other plate for axially moving said other plate upon actuation of said gear motor.

31. The apparatus of claim 30 further comprising a current detector operatively coupled to said gear motor for sensing an increase in current load on said motor, and a control for stopping and reversing said motor until a predetermined gap is established between said first and second plates.

32. The apparatus of claim 29 further comprising a material distributing plate mounted for rotation within said housing and radially disposed between said space and said inlet, said material distributing plate being axially adjustable with respect to said second plate.

33. The apparatus of claim 32 wherein said material distributing plate is adjustably secured to said second plate and wherein said second plate is mounted for rotation within said housing.

34. The apparatus of claim 32 wherein said material distributing plate includes a plurality of fins extending outwardly at angularly spaced locations from an inner surface thereof.

35. The apparatus of claim 32 wherein a plurality of curved adjustment slots extend through said material distributing plate at angularly spaced locations thereof and said material distributing plate further comprises a plurality of stepped adjustment blocks rigidly affixed thereto proximate said adjustment slots and a plurality of fasteners extending through said slots to secure said material distributing plate to said second plate such that a first step of each stepped adjustment block bears against a portion of said second plate, whereby removal of said fasteners allows said material distributing plate to be axially adjusted with respect to said second plate and affixed in a new axial location by securing said fasteners to said second plate with another step of said stepped adjustment block bearing against said portion of said second plate.

36. The apparatus of claim 29 wherein said second plate is a grinding plate including a roughened grinding surface.

37. The apparatus of claim 36 wherein said grinding surface is annularly shaped and a rotatable material distributing plate having a plurality of fins extending therefrom is mounted centrally of said grinding surface.

38. The apparatus of claim 36 wherein said grinding plate includes a plurality of grinding segments removably attached thereto, each grinding segment having an outer grinding surface defining a portion of said roughened grinding surface.

39. The apparatus of claim 29 wherein said cutting surface on said first plate comprises a plurality of generally radially extending ribs.

40. The apparatus of claim 39 wherein outer edge surfaces of said ribs lie in a common plane.

41. The apparatus of claim 40 where said cutting surface of said second plate generally lies in a plane parallel to said common plane defined by the outer edge surfaces of said ribs.

42. The apparatus of claim 29 wherein said cutting surface of said second plate comprises a plurality of radially extending knives extend outwardly toward said cutting surface of said first plate.

43. The apparatus of claim 42 wherein said cutting surface of said first plate comprises a plurality of generally radially extending ribs.

44. The apparatus of claim 43 wherein outer edge surfaces of said ribs lie in a common plane.

45. The apparatus of claim 42 wherein said knives are removably affixed to said second plate.

* * * * *